US010028528B2

(12) United States Patent
Pero et al.

(10) Patent No.: US 10,028,528 B2
(45) Date of Patent: Jul. 24, 2018

(54) EXHALATION SMOKE FILTER MASK

(71) Applicants: Antonino M. Pero, Lakewood, CO (US); Jason Bagley, Denver, CO (US)

(72) Inventors: Antonino M. Pero, Lakewood, CO (US); Jason Bagley, Denver, CO (US)

( * ) Notice: Subject to any disclaimer, the term of this patent is extended or adjusted under 35 U.S.C. 154(b) by 184 days.

(21) Appl. No.: 15/170,664

(22) Filed: Jun. 1, 2016

(65) Prior Publication Data

US 2016/0331021 A1 Nov. 17, 2016

Related U.S. Application Data

(60) Provisional application No. 62/169,013, filed on Jun. 1, 2015.

(51) Int. Cl.
*A24F 13/00* (2006.01)

(52) U.S. Cl.
CPC ..... *A24F 13/00* (2013.01)

(58) Field of Classification Search
None
See application file for complete search history.

(56) References Cited

U.S. PATENT DOCUMENTS

| | | | | |
|---|---|---|---|---|
| 4,369,798 | A | 1/1983 | Jackson | |
| 4,993,435 | A | 2/1991 | McCann | |
| 5,469,870 | A | 11/1995 | Meador | |
| 5,495,859 | A | 3/1996 | Bowen et al. | |
| 5,568,819 | A | 10/1996 | Gentry et al. | |
| 5,598,853 | A | 2/1997 | Hyre | |
| 5,638,833 | A | 6/1997 | Bowen et al. | |
| 5,908,479 | A | 6/1999 | Wampole | |
| 6,006,757 | A * | 12/1999 | Lichtenberg | A24F 13/00 131/187 |
| 6,345,625 | B1 | 2/2002 | Chew | |
| 6,615,843 | B2 | 9/2003 | Pera | |
| 7,552,735 | B2 | 6/2009 | Xue et al. | |
| D685,131 | S | 6/2013 | Gorski | |
| 2004/0237984 | A1 | 12/2004 | Figlar et al. | |
| 2005/0016551 | A1 | 1/2005 | Kane, Jr. et al. | |
| 2005/0142075 | A1* | 6/2005 | Rast | A21C 15/007 424/48 |
| 2006/0289022 | A1 | 12/2006 | Backman | |
| 2007/0204868 | A1 | 9/2007 | Bollinger et al. | |
| 2008/0060664 | A1 | 3/2008 | Richards | |
| 2009/0056728 | A1* | 3/2009 | Baker | A24F 13/00 131/191 |
| 2011/0073120 | A1 | 3/2011 | Adamic | |
| 2011/0240047 | A1* | 10/2011 | Adamic | A24F 1/00 131/328 |
| 2013/0228188 | A1 | 9/2013 | Sakai | |
| 2014/0060557 | A1 | 3/2014 | Mai et al. | |

* cited by examiner

*Primary Examiner* — Dennis R Cordray
(74) *Attorney, Agent, or Firm* — Williams Intellectual Property; Benjamin F. Williams

(57) ABSTRACT

An exhalation smoke filter mask includes an open first end and a perforated second end enclosing a filter assembly. The filter assembly includes a main filter assembly, having at least a carbon filter, and a masking filter assembly, having at least a fabric member infused with volatilizing odorous oils. Exhalation of smoke into the open first end effects filtering of the smoke by action of the carbon filter and malodors are masked by volatilization of odorous oils vented when breath is forced through the filter assembly. Thus secondhand smoke is mitigated, malodors are eliminated, and exhalations of smoke are concealable from bystanders and passersby.

7 Claims, 5 Drawing Sheets

EXHALATION SMOKE FILTER MASK

CROSS-REFERENCE TO RELATED APPLICATIONS

This nonprovisional application for utility patent claims the benefit of provisional application no. 62/169,013 filed on Jun. 1, 2015

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of smoking systems devised to control secondhand smoke are known in the prior art. However what is needed is an exhalation smoke filter mask that filters smoke breathed into an open first end and also masks malodors associated with smoking by venting volatilizing odorous oils when a user exhales through a masking filter assembly.

The present device, therefore, includes a filter assembly having a main filter assembly and a masking filter assembly. The main filter assembly includes an activated carbon filter and the masking filter assembly includes a fabric member infused with volatilizing odorous oils. When a user exhales smoke into the open first end, smoke is first filtered in the main filter assembly, wherein smoke particles are sorbed to surfaces predominant in the active carbon filter, and the exhalation is then masked by action of volatilized odorous oils producible when airflow through the masking filter assembly is effected.

In one embodiment of the invention, an inner sleeve member, devised to house the filter assembly, is securable interior to an outer sleeve member. The inner sleeve member may be disposable, while the outer sleeve member may be retained for reuse. In another embodiment, the device is devised for portability, rendered pocket-sized, and includes a disposable member having the filter assembly therein.

In all embodiments, filtering of exhaled smoke is effective and concealment of associated malodors is enabled by production of odorous oils vented from the device during use. Secondhand smoke is thus mitigatible, and exhalations of smoke are likewise concealable from bystanders and passersby.

FIELD OF THE INVENTION

The present invention relates to an exhalation smoke filter mask devised to filter smoke and mask malodors caused by secondhand smoke. The present invention includes an elongate, preferably tubular body, having at least an open first end and a perforated second end. A filter assembly is enclosed between said open first end and said perforated second end. The filter assembly includes a main filter assembly, disposed to filter smoke and sorb smoke particles therein, and a masking filter assembly, disposed to mask malodors by volatilization of odorous oils evaporated when airflow is directed through the filter assembly.

In one embodiment an inner sleeve member secures longitudinally mounted inside an outer sleeve member. In this embodiment the filter assembly is disposed interior to the inner sleeve member, which may be disposable. A user may thus switch and interchange inner sleeve members in use in a single outer sleeve member, whereby different scents are producible, as desired, to mask malodors during use. In a second embodiment, devised for maximized portability, a disposable pocket-sized device enables discreet use to filter and mask secondhand smoke and conceal exhalations from bystanders and passersby.

SUMMARY OF THE INVENTION

The present exhalation smoke filter mask has been devised to enable concealment of exhaled smoke from bystanders and passersby. The present exhalation smoke filter mask filters smoke exhaled into an open first end and, further, masks malodors associated with smoking by emitting volatized odorous oils when the exhalation is vented out a second perforated end.

Several embodiments are contemplated, but each embodiment includes at least an elongate, tubular body having an open first end and a perforated second end, wherein a filter assembly scrubs smoke and volatilizing odorous oils, infused in a masking filter assembly, release scent to mask malodors. Thus exhaled smoke is filtered and masked when directed through the present device.

A first embodiment includes an inner sleeve member insertibly securable inside an outer sleeve member. In practicing this embodiment, a user may thus renew the inner sleeve member, which contains the filter assembly, as desired, or switch out said inner sleeve member to make use of differing scented oils released by the device during various use. A second embodiment is devised for portage in a pocket, and consists of a single, disposable body wherein the filter assembly is contained.

The first embodiment, then, includes the inner sleeve member and the outer sleeve member. The outer sleeve member includes an open first end and an open second end. The inner sleeve member slidingly secures longitudinally disposed interior to the outer sleeve member by insertion into the open first end. The inner sleeve member includes a first end and a perforated second end. When installed into the outer sleeve member, the inner sleeve member perforated second end interiorly abuts the outer sleeve member open second end and the first end seats into the open first end as will be described subsequently.

The outer sleeve member includes a raised circumference at the open first end, whereby the open first end has a larger diameter than the rest of the outer sleeve member. The inner sleeve member includes a ring cap attachable circumferentially around the inner sleeve first end, which ring cap secures into the outer sleeve member open first end and maintains position of the inner sleeve member inside the outer sleeve member by frictional engagement at the raised circumference.

The filter assembly is disposed interior to the inner sleeve member. In this embodiment the filter assembly includes a main filter assembly and a masking filter assembly. The main filter assembly is disposed to filter smoke breathed into the inner sleeve member, and sorb smoke particles to an activated carbon filter. The masking filter assembly is devised to release volatilized odorous oils when smoke is forced therethrough whereby malodors of smoke are masked.

The main filter assembly includes a screen member disposed at the first end and a carbon filter. The carbon filter comprises activated carbon and may be devised as a mesh, a baffle, a spiraled slug, or other carbonized medium porous to the passage of air when a user breathes therethrough. The masking filter assembly includes a first poly batting wad, a fabric member infused with volatilizing odorous oils, and a second poly batting wad. A final felt member may be included abutting the perforated second end.

The first and second poly batting wads comprise tangled masses of filamentous fibers and strands, and volumetrically occupy space to maintain position of the components of the filter assembly while enabling passage of air when a user exhales into the device. The fabric member may include an absorbent sponge, or an absorbent fabric sheet disposed to release odorous oils when a user exhales into the filter assembly. The fabric member may further include a fabric center wrapped into a spherical arrangement, which fabric center is subsequently wrapped in a fabric sheet. In this embodiment, the fabric center and the fabric sheet are infused with volatilizing odorous oils. The fabric sheet is wrapped around the fabric center in a teardrop shape, presenting a distal end foremost towards the open first end. Exposure to the volatilizing oils is thus increased as exhaled smoke is borne through the device to vent out the perforated second end.

The fabric member may also be devised as a cylindrical slug. In such an embodiment the fabric member enables passage of airflow through an open center and volatilized odorous oils are released from surfaces surrounding the open center as airflow is directed thereabouts.

Thus, a user is enabled to exhale smoke into embodiments of the present device to effectively conceal odors associated with smoking.

Thus has been broadly outlined the more important features of the present exhalation smoke filter mask so that the detailed description thereof that follows may be better understood and in order that the present contribution to the art may be better appreciated.

Objects of the present exhalation smoke filter mask, along with various novel features that characterize the invention are particularly pointed out in the claims forming a part of this disclosure. For better understanding of the exhalation smoke filter mask, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
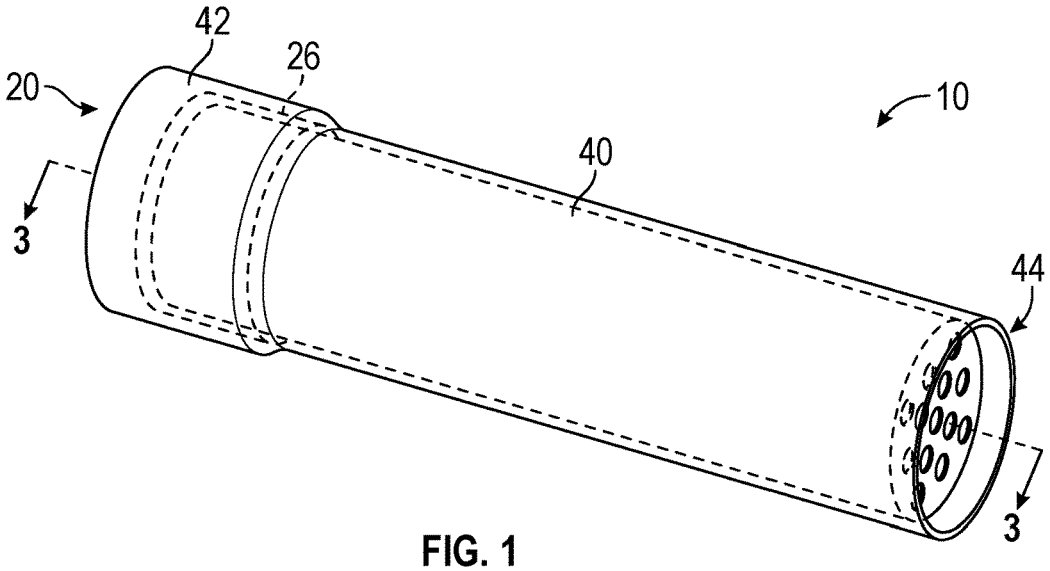
FIG. 1 is a side view of an example embodiment.
Figure 2:
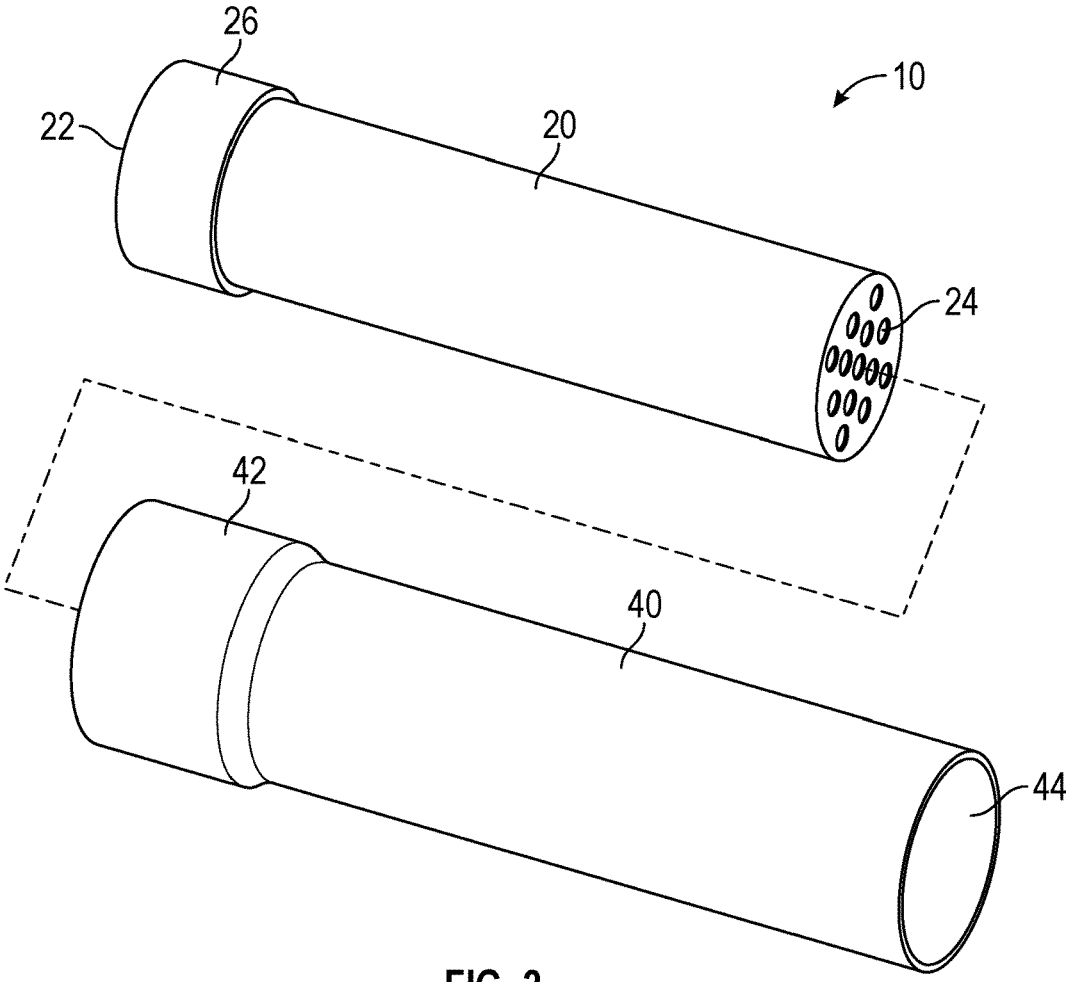
FIG. 2 is a side view of an example embodiment having an inner sleeve member illustrated removed from an outer sleeve member.

With reference now to the drawings, and in particular FIGS. 1 through 9 thereof, example of the instant exhalation smoke filter mask employing the principles and concepts of the present exhalation smoke filter mask and generally designated by the reference number 10 will be described.

The present exhalation smoke filter mask 10 has been devised to enable filtering of exhaled smoke and, also, to mask smoking malodors by emitting a scented oil activated by airflow when a user exhales into the device 10. Smoke exhaled by a user into the device 10, then, is filtered by activated carbon and masked by scented oils whereby exhaled smoke is concealable from bystanders, passersby, and observers.

In all embodiments, the exhalation smoke filter mask 10 includes an elongate, tubular body having an open first end 22 and a perforated second end 24. The open first end 22 is adapted for position in contact around the lips of a user whereby said user may exhale into the open first end 22. Smoke exhaled thereinto is borne through the elongate tubular body and filtered through a filter assembly 30 before emission through the perforated second end 24.

The filter assembly 30 includes a main filter assembly 32 and a masking filter assembly 34. The main filter assembly 32 includes a carbon filter 36 having activated carbon disposed as a porous body through which gas is caused to pass when a user exhales into the first end 22. Smoke particles are thusly sorbed to surfaces predominant in the activated carbon. The masking filter assembly 34 includes a fabric member 38 infused with volatilizing odorous oils 100 whereby passage of gas across the fabric member 38 effects volatilization of the odorous oils 100 to mask malodors and conceal the exhalation (see for example FIG. 9).

In one embodiment of the present exhalation smoke filter mask 10, an outer sleeve member 40 includes an enlarged open first end 42 and an open second end 44. An inner sleeve member 20 slidably inserts into the outer sleeve member 40 at the open first end 42 to seat longitudinally inside the outer sleeve member 40. The inner sleeve member 20 includes a first end 22 and a perforated second end 24. A ring cap 26 is disposed perimetrically at the first end 22, said ring cap 26 devised to securably seat into the outer sleeve member 40 open first end 42 and frictionally engage thereagainst to secure the inner sleeve member 20 interior to the outer sleeve member 40.

In this embodiment, the filter assembly 30 is disposed interior to the inner sleeve member 20, between the inner sleeve member first end 22 and the inner sleeve member perforated second end 24. The filter assembly 30 includes the main filter assembly 32 and the masking filter assembly 34. The main filter assembly 32 includes a screen member 33 disposed at the first end 22, there disposed to maintain a carbon filter 36 in position adjacent the screen member 33. The carbon filter 36 is contemplated to include an activated carbon mesh, wherein the carbon filter 36 is porous to gasses forced therethrough whereby smoke particles are adsorbed to charged surfaces predominant in the activated carbon.

Thus an exhalation of smoke is filterable through the carbon filter 36 and smoke particles are thereby capturable by the carbon filter 36.

The masking filter assembly 34 includes a first poly batting wad 50, a fabric member 38 infused with volatizing odorous oils 100, a second poly batting wad 54 and, in some embodiments, a final felt filter member 56 disposed to maintain the masking filter assembly 34 in position most proximal the perforated second end 24 of the inner sleeve member 20.

Each of the first and second poly batting wads 50, 54 is comprised of a tangle of fibrous and filamentous strands that volumetrically maintain position of the main filter assembly 32 and the masking filter assembly 34 relative one another interior to the inner sleeve member 20. Smoke exhaled into the device 10 is enabled passage between the tangled fibrous and filamentous strands comprising said first and second poly batting wads 50, 54.

Figure 3:
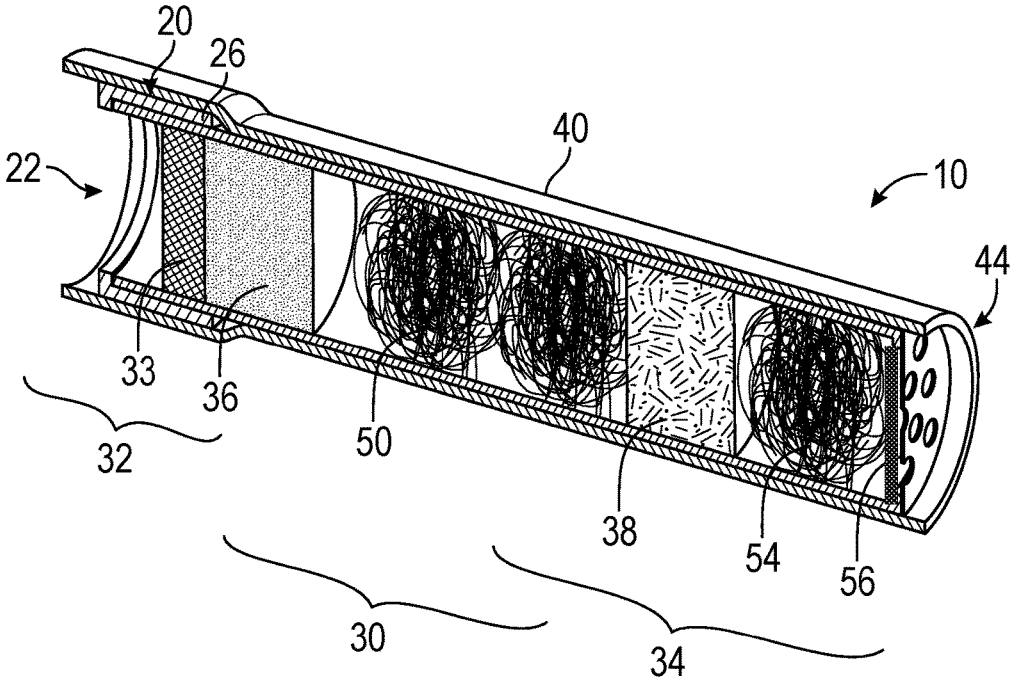
FIG. 3 is a longitudinal cross-section view taken along line 3-3 of FIG. 1 illustrating a filter assembly therein.
Figure 4:
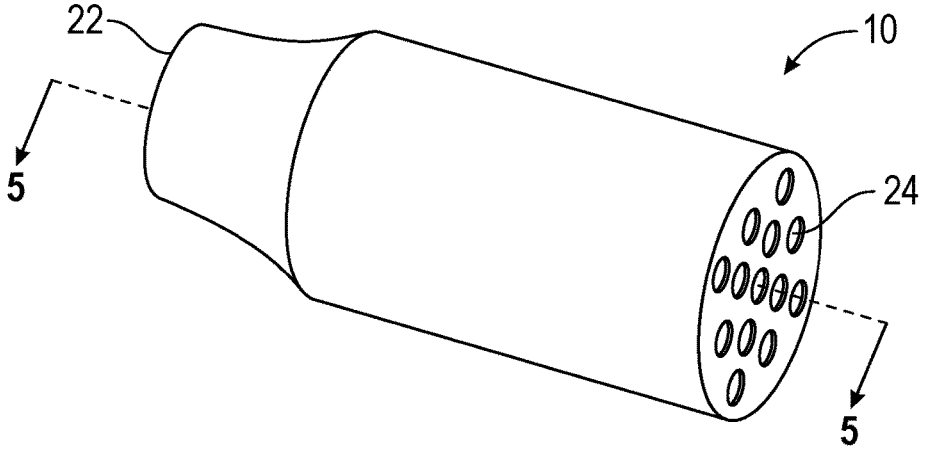
FIG. 4 is a side view of a pocket-sized example embodiment.
Figure 5:
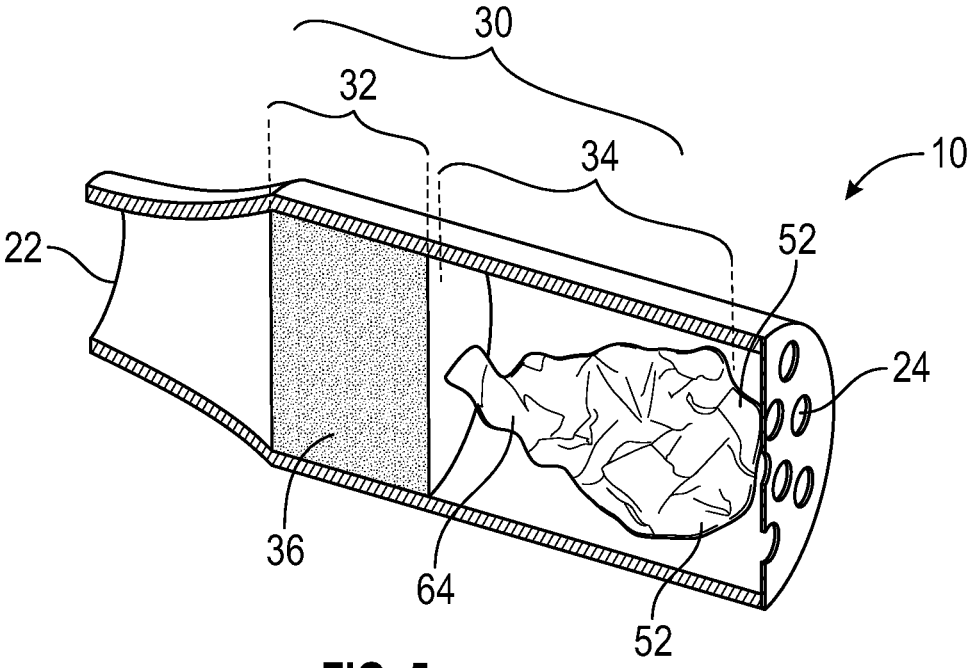
FIG. 5 is a longitudinal cross-section view taken along line 5-5 of FIG. 4 illustrating a filter assembly therein, said filter assembly including a fabric center wrapped in a fabric sheet.
Figure 6:
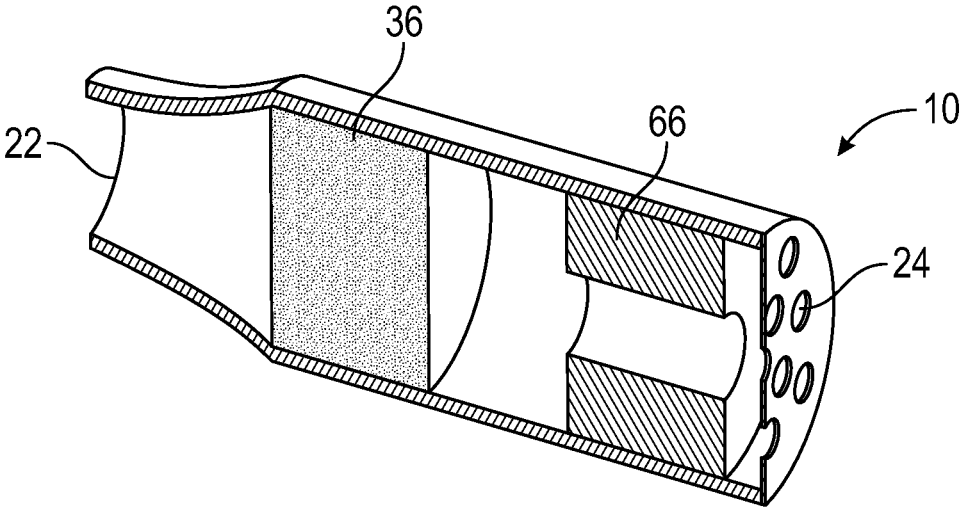
FIG. 6 is a longitudinal cross-section view taken along line 5-5 of FIG. 4 illustrating an alternate filter assembly therein, said filter assembly including a cylindrical slug.
Figure 7:
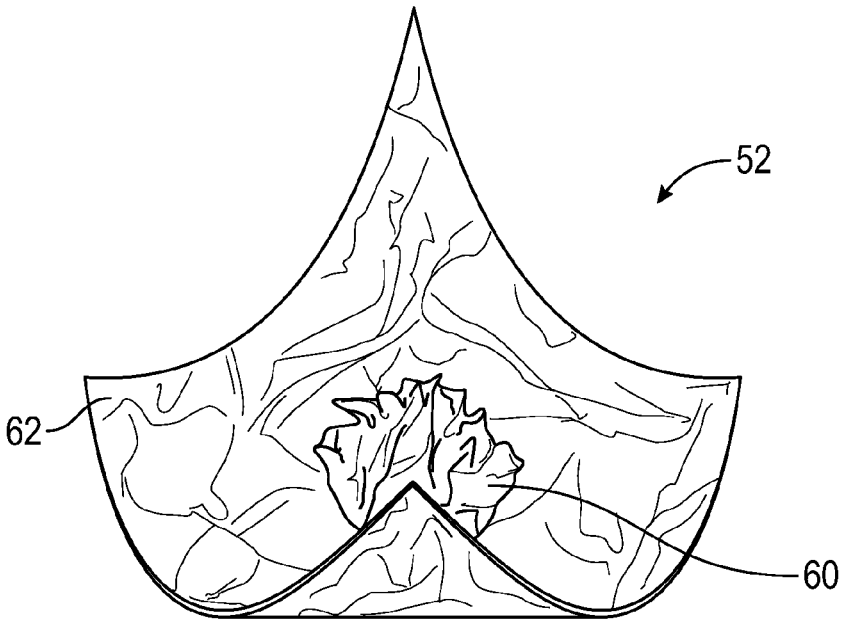
FIG. 7 is a detail view of the fabric center and fabric sheet infused with volatilizing odorous oils.
Figure 8:
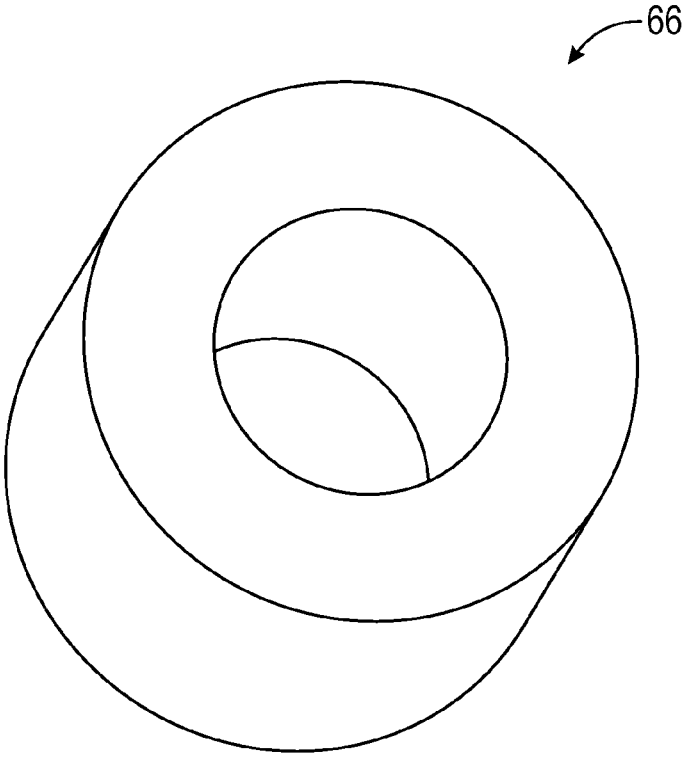
FIG. 8 is a detail view of the cylindrical slug infused with volatilizing odorous oils.
Figure 9:
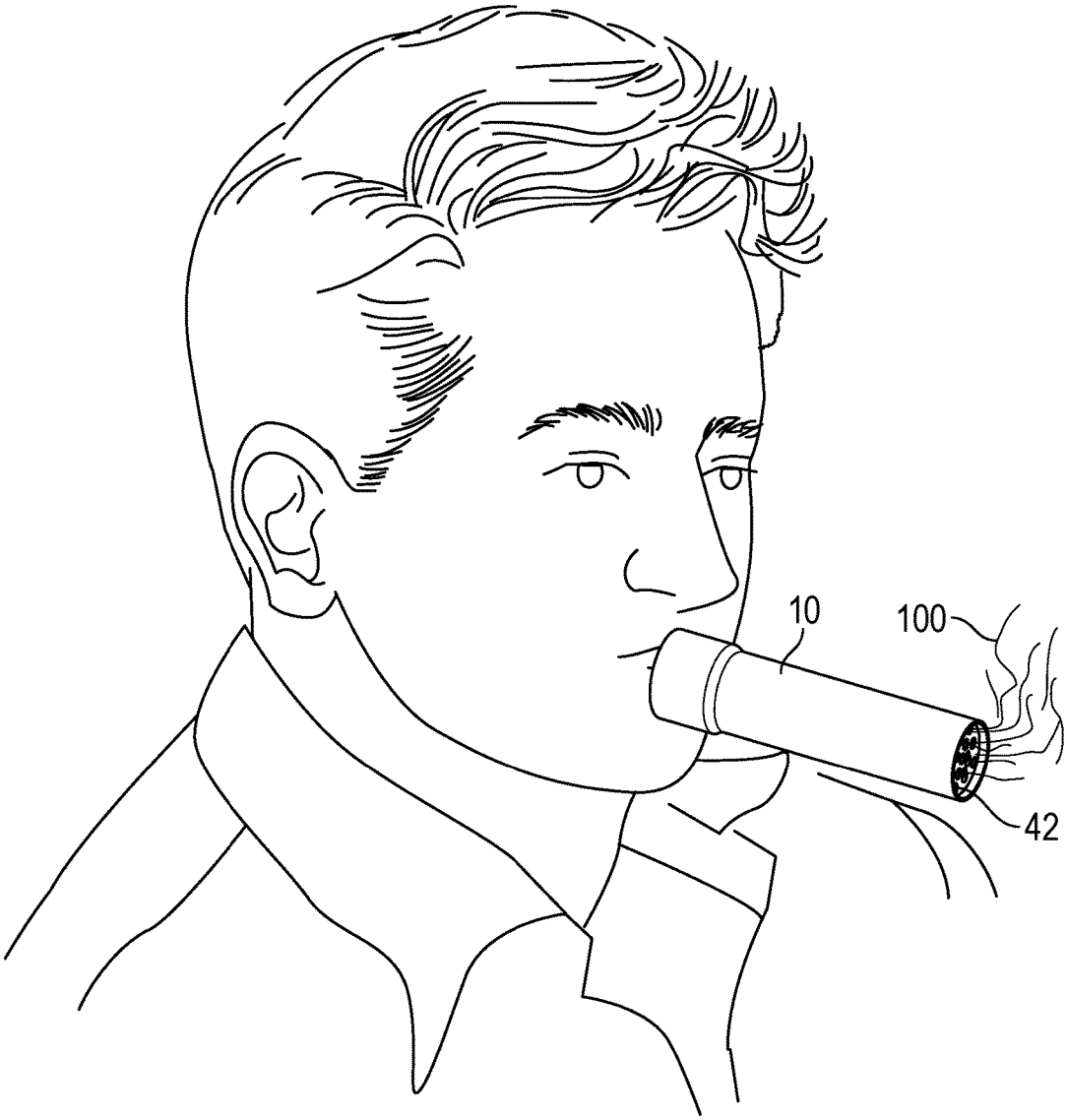
FIG. 9 is an in-use view illustrating production of volatilized odorous oils to mask malodors of smoke exhaled into the device.

The fabric member 52 may include fibrous elements, to partially obstruct airflow through the device (see, for example. FIG. 3), or, in another embodiment, may comprise a fabric center 60 wrapped into a spherical arrangement around which fabric center 60 a fabric sheet 62 is subsequently wrapped and tapered into a teardrop shape to present a distal end 64 facing towards the first end 22 (see, for example, FIG. 5). Thus exhalations are caused to pass across the distal end 64 and around the wrapped spherical fabric center 60. Volatilizing odorous oils 100 infused upon the fabric center 60 and the fabric sheet 62 are thus released into passing gasses for venting out the perforated second end 24 of the inner sleeve member 20, and thus out the open second end 44 of the outer sleeve member 40, whereby malodors caused by smoking are masked and mitigated (see FIG. 9).

In another embodiment, devised for portability, the present device 10 is reduced in size for convenient portage in the pocket of a user, and consists of a singular, tubular body having a first end 22 and a perforated second end 24. In this embodiment, the main filter assembly 32 includes at least one carbon filter 36 and the masking filter assembly 34 includes a fabric sheet 62 or a cylindrical slug 66 infused with volatilizing odorous oils. In this embodiment, a user exhales smoke directly into the first end 22 for filtering at the carbon filter 36 and fabric member 52 disposed therein. The first end 22 may be tapered to present a narrowing whereby the filter assembly 30 is prevented from falling out the open end 22.

What is claimed is:

1. An exhalation smoke filter mask having an elongate, tubular body and comprising:
- an open first end;
- a perforated second end;
- a filter assembly disposed between the first end and the perforated second end, said filter assembly having:
  - a main filter assembly including a carbon filter; and
  - a masking filter assembly including:
    - a fabric center infused with volatilizing odorous oils, said fabric center wrapped into a spherical arrangement; and
    - a fabric sheet infused with volatilizing odorous oils, said fabric sheet wrapped around the fabric center, said fabric sheet tapering to a distal point oriented towards the open first end;
- wherein the exhalation of smoke by a user into the first end scrubs said smoke of particles and malodors.

2. The exhalation smoke filter mask of claim 1 further comprising:
- an outer sleeve member having an open first end and an open second end;
- an inner sleeve member slidably insertible into the outer sleeve member to seat longitudinally inside said outer sleeve member, said inner sleeve member having:
  - a first end;
  - a perforated second end; and
  - a ring cap disposed perimetrically about the first end, said ring cap devised to seat into the outer sleeve member open first end and frictionally engage thereat;
- wherein the filter assembly is disposed between the first end of the inner sleeve member and the perforated second end of the inner sleeve member whereby removal of the inner sleeve member enables disposal and interchange of the filter assembly.

3. The exhalation smoke filter mask of claim 2 wherein the main filter assembly comprises a screen member disposed at the first end of the inner sleeve member whereby the carbon filter is disposed adjacent said screen member.

4. The exhalation smoke filter mask of claim 3 wherein the masking filter assembly comprises:
- a first poly batting wad;
- and
- a second poly batting wad;
- wherein smoke exhaled into the open first end of the outer sleeve member effects volatilization of said volatilizing odorous oils effective to produce a masking scent.

5. An exhalation smoke filter mask having an elongate, tubular body and comprising:
- an open first end;
- a perforated second end;
- a filter assembly disposed between the first end and the perforated second end, said filter assembly having:
  - a main filter assembly having:
    - a screen member;
    - a carbon filter;
  - a masking filter assembly infused with volatilizing odorous oils, said masking filter assembly having:
    - a fabric center wrapped into a spherical arrangement; and
    - a fabric sheet wrapped around the fabric center, said fabric sheet tapering to a distal point oriented towards the open first end;
- wherein smoke exhaled by a user into the first end filters said smoke through the carbon filter to sorb smoke particles therein and volatilization of the odorous oils releases scent effective to mask malodors of the exhaled smoke.

6. An exhalation smoke filter mask having an elongate, tubular body and comprising:
- an outer sleeve member having an open first end and an open second end;
- an inner sleeve member slidably insertible into the outer sleeve member at the open first end, said inner sleeve member devised to seat longitudinally inside the outer sleeve member, said inner sleeve member comprising:
  - a first end;
  - a perforated second end;
  - a ring cap perimetrically attachable at the first end, said ring cap devised to seat into the outer sleeve member open first end and frictionally engage therein;
  - a filter assembly disposed interior to the inner sleeve member, said filter assembly disposed between the inner sleeve member first end and the inner sleeve member perforated second end, said filter assembly comprising:

a main filter assembly having:

a screen member disposed at the first end;

a carbon filter disposed adjacent the first screen member;

a masking filter assembly having;

a first poly batting wad;

a fabric member infused with volatizing odorous oils;

a second poly batting wad; and a final felt filter member;

wherein exhalation of smoke into the open first end of the outer sleeve member forces said smoke into the inner sleeve member, through the main filter assembly and the masking filter assembly, to sorb smoke particles therein and emit scent from the perforated second end whereby said smoke is filtered and masked.

7. The exhalation smoke filter mask of claim 6 wherein the fabric member is cylindrical.

* * * * *